US009918555B2

(12) United States Patent
Gopalakrishnan et al.

(10) Patent No.: US 9,918,555 B2
(45) **Date of Patent: *Mar. 20, 2018**

(54) ADJUSTABLE BED WITH STORAGE COMPARTMENT

(71) Applicant: L&P PROPERTY MANAGEMENT COMPANY, Southgate, CA (US)

(72) Inventors: Vinod Kumar Gopalakrishnan, Carthage, MO (US); Jacob J. Neuenswander, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 129 days.

This patent is subject to a terminal disclaimer.

(21) Appl. No.: 14/793,437

(22) Filed: Jul. 7, 2015

(65) Prior Publication Data

US 2017/0007030 A1 Jan. 12, 2017

(51) Int. Cl.

| | |
|---|---|
| ***A47C 17/86*** | (2006.01) |
| ***A47C 19/02*** | (2006.01) |
| ***A47C 20/04*** | (2006.01) |

(52) U.S. Cl.

CPC ..... *A47C 17/86* (2013.01); *A47C 19/021* (2013.01); *A47C 20/041* (2013.01)

(58) Field of Classification Search

CPC ..... A61G 7/015; A61G 13/105; A61G 13/08; A47C 20/041; A47C 17/86; A47C 19/22; A47C 19/021

See application file for complete search history.

(56) References Cited

U.S. PATENT DOCUMENTS

| | | | | |
|---|---|---|---|---|
| 5,020,173 | A * | 6/1991 | Dreyer, Jr. | A47C 19/045 297/188.1 |
| 2005/0278858 | A1* | 12/2005 | Polevoy | A47C 19/005 5/663 |
| 2007/0245489 | A1* | 10/2007 | Boudreau | A47C 19/021 5/174 |
| 2007/0256240 | A1* | 11/2007 | Regev | A47C 17/86 5/412 |
| 2008/0276373 | A1* | 11/2008 | Clenet | A47C 20/041 5/618 |
| 2010/0199433 | A1* | 8/2010 | Clenet | A61G 7/015 5/618 |
| 2011/0094030 | A1* | 4/2011 | Harrington | A47B 81/005 5/503.1 |
| 2011/0247138 | A1* | 10/2011 | Clenet | A47C 20/04 5/613 |

* cited by examiner

*Primary Examiner* — Eric J Kurilla

(74) *Attorney, Agent, or Firm* — Shook, Hardy & Bacon L.L.P.

(57) ABSTRACT

An adjustable bed is provided. The adjustable bed can include an outer support perimeter that provides structural support to various components of the adjustable bed. The outer support perimeter can include a plurality of panels, where two panels can be coupled together by a panel connecting member which can be received inside a void of both panels. The panel connecting member can be secured to the two panels using one or more fasteners in such a manner that the fasteners are not visible on the outside surface of the outer support perimeter. The adjustable bed can include a storage compartment positioned beneath a foot segment of a mattress support member. The storage compartment can be accessed by pivoting the foot segment of the mattress support member up and away from the adjustable bed.

17 Claims, 6 Drawing Sheets

ADJUSTABLE BED WITH STORAGE COMPARTMENT

CROSS-REFERENCE TO RELATED APPLICATIONS

This Application is related to commonly assigned U.S. patent application Ser. No. 14/793,449 entitled "Adjustable Bed with Outer Support Perimeter," filed concurrently herewith on the same date.

STATEMENT REGARDING FEDERALLY SPONSORED RESEARCH OR DEVELOPMENT

Not applicable.

TECHNICAL FIELD

Aspects of this disclosure relate to an adjustable bed. More particularly, this disclosure includes embodiments relating to an adjustable bed that includes an outer support perimeter that can provide structural support for numerous components utilized in adjustable beds.

BACKGROUND

Certain adjustable beds can include a frame for supporting numerous adjustable bed components. Adjustable beds can also include a decorative bolster as an outer perimeter to cover the frame and other internal components of adjustable beds. Certain decorative bolsters do not provide any structural support for the various components of the bed; instead, such decorative bolsters only cover the structural supports and any other internal components. There is a need for an adjustable bed where an outer perimeter of the adjustable bed can provide the structure to support various adjustable bed components.

BRIEF SUMMARY

The present disclosure generally relates to an adjustable bed that includes an outer support perimeter that provides support to various adjustable bed components. The outer support perimeter disclosed herein can include a plurality of panels, where each panel can include two layers coupled together, e.g., an inner layer and an outer layer. Two panels can be coupled together by a panel connecting member which can be received inside a void of both panels. The panel connecting member can be secured to the two panels using one or more fasteners in such a manner that the fasteners are not visible on the outside surface of the outer support perimeter. In embodiments, the adjustable bed can include a storage compartment positioned beneath a foot segment of a mattress support. The storage compartment can be accessed by pivoting the foot segment of the mattress support up and away from the bottom surface of the storage compartment.

Accordingly, in one embodiment, an adjustable bed is provided. The adjustable bed includes a mattress support and a frame assembly configured to support the mattress support and a mattress. The adjustable bed also includes an outer support perimeter coupled to the frame assembly. The outer support perimeter includes a plurality of panels and a plurality of panel connecting members. A first panel connecting member of the plurality of panel connecting members at least partly couples together two panels of the plurality of panels, thereby creating a connection seam. The first panel connecting member is at least partly received inside an interior void of each of the two panels of the plurality of panels.

In another embodiment, an adjustable bed is provided. The adjustable bed includes a mattress support that includes first and second segments pivotably coupled together. The adjustable bed also includes a frame assembly configured to support the mattress support and a mattress, and an adjustor assembly at least partly coupled to the frame assembly and configured to shift the mattress support into a plurality of configurations. The adjustable bed further includes an outer support perimeter including: (1) opposing first and second side panels; (2) opposing head and foot panels; and (3) a plurality of panel connecting members. At least one panel connecting member of the plurality of panel connecting members couples together an end of the first panel to an end of the foot panel such that the at least one panel connecting member is at least partly received inside an interior void of each of the first panel and the foot panel.

In yet another embodiment, an adjustable bed is provided. The adjustable bed includes a frame assembly and a mattress support having opposing interior and exterior surfaces. The frame assembly is coupled to at least a portion of the interior surface of the mattress support. The exterior surface of the mattress support is configured to contact and support a mattress. The mattress support includes a foot segment and a leg segment pivotably coupled to one another. The adjustable bed also includes an adjustor assembly coupled to the frame assembly and in contact with a portion of the interior surface of the mattress support. The adjustor assembly is configured to shift the mattress support into a plurality of configurations. The adjustable bed further includes a storage compartment defined by a bottom surface, at least one sidewall, and at least a portion of the interior surface of the mattress support that opposes at least a portion of the bottom surface. The storage compartment is configured to be accessible by shifting the foot segment of the mattress support away from the bottom surface of the storage compartment.

In another embodiment, an adjustable bed is provided. The adjustable bed includes a frame assembly and a mattress support that includes a foot segment and a leg segment pivotably coupled to one another. The adjustable bed also includes an adjustor assembly coupled to the frame assembly and contacting a portion of the mattress support. The adjustor assembly is configured to shift the mattress support into a plurality of configurations. The adjustable bed further includes a storage compartment defined by a bottom surface, at least one sidewall, and at least a portion of the foot segment of the mattress support. The storage compartment is configured to be accessible by shifting the foot segment of the mattress support away from the bottom surface of the storage compartment. The adjustable bed also includes at least one extension member configured to facilitate the shifting of the foot segment up and away from the storage compartment.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

For purposes of this disclosure, the word "including" has the same broad meaning as the word "comprising." In addition, words such as "a" and "an," unless otherwise indicated to the contrary, include the plural as well as the singular. Thus, for example the requirement of "a feature" is satisfied where one or more features are present. Also, the term "or" includes the conjunctive, the disjunctive and both (a or b thus includes either a or b, as well as a and b).

Figure 1:
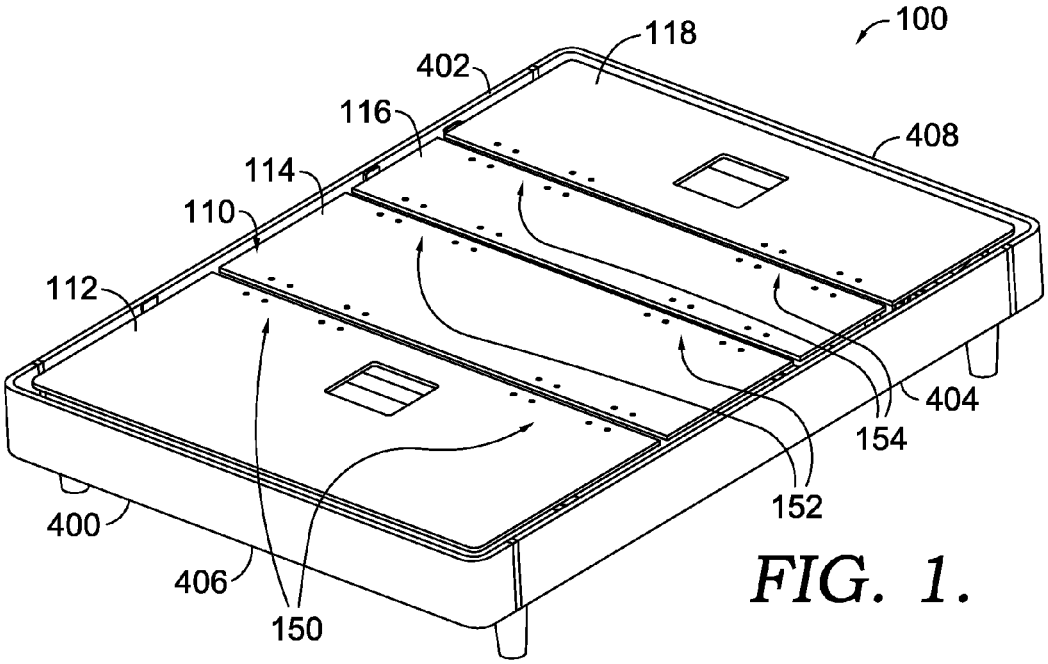
FIG. 1 is a top perspective view of an adjustable bed, particularly showing the outer support perimeter and the mattress support, in accordance with an embodiment of the present invention.
Figure 2:
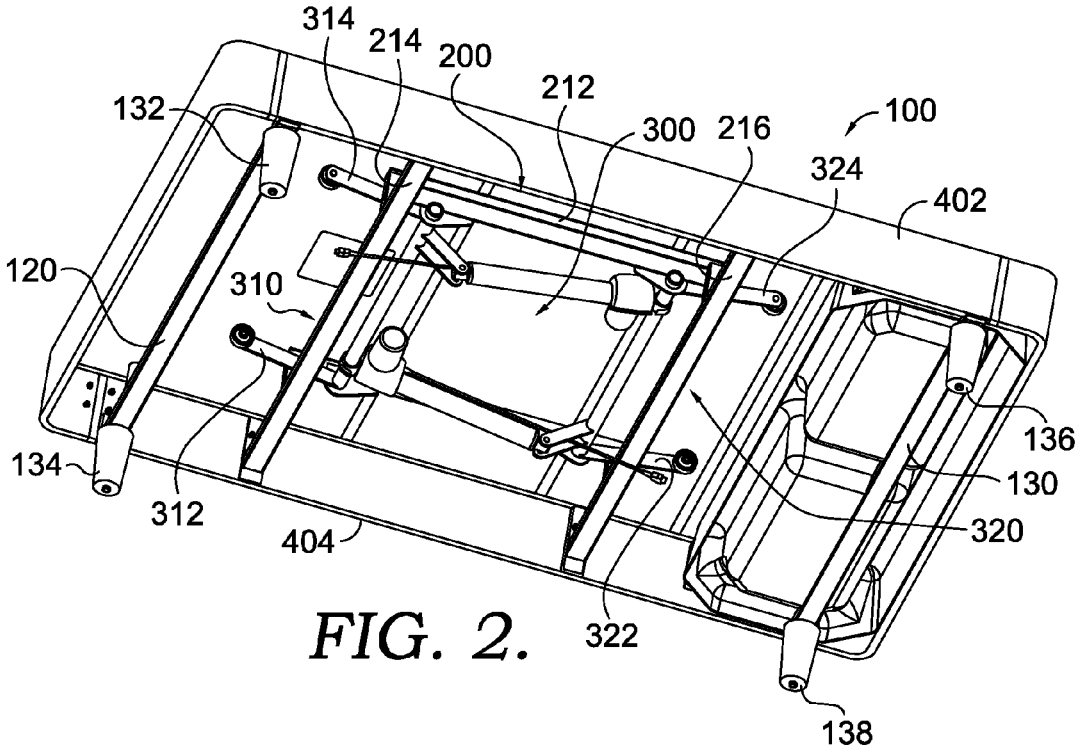
FIG. 2 is a bottom perspective view of the adjustable bed of FIG. 1, particularly showing the frame assembly, the adjustor assembly, the leg support brackets, the storage compartment, and the outer support perimeter, in accordance with an embodiment of the present invention.
Figure 3:
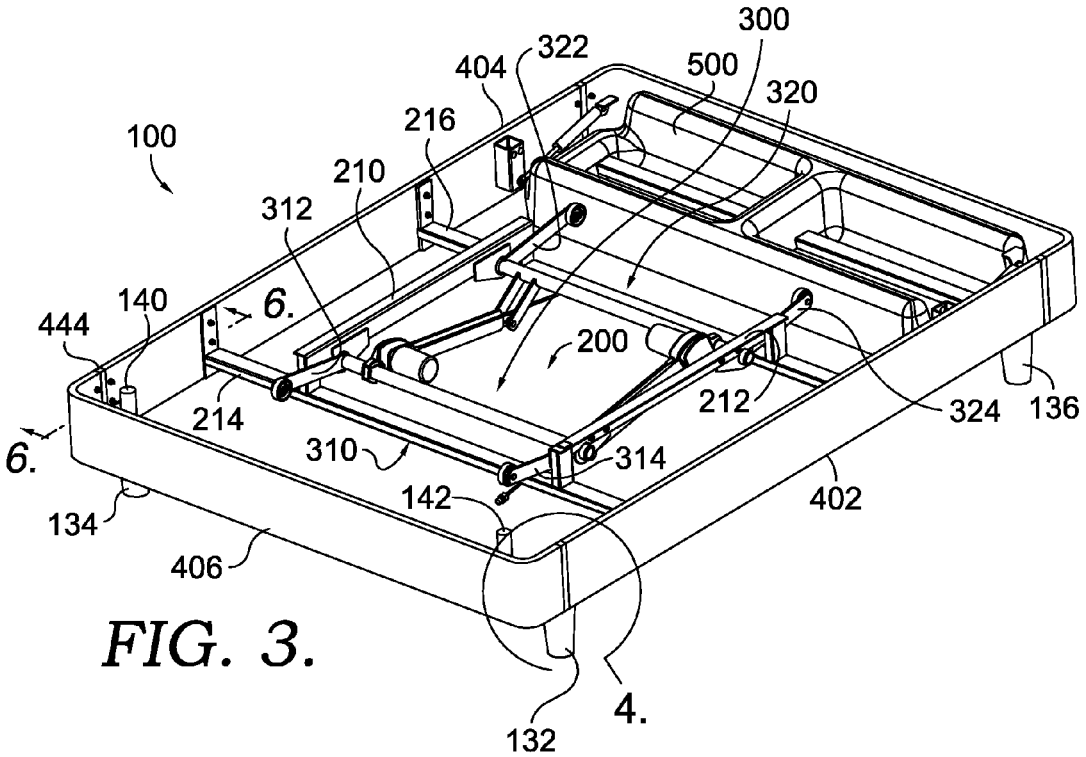
FIG. 3 is a top perspective view of the adjustable bed of FIG. 1, having the mattress support removed to illustrate the position of the storage compartment, the frame assembly, and the adjustor assembly, in accordance with an embodiment of the present invention.

Turning now to the figures, FIGS. 1-3 depict an adjustable bed 100. It should be understood that the adjustable bed 100 depicted in the figures is provided for demonstrative purposes only, and thus, the present invention may be employed with any type of adjustable bed. As best seen in FIG. 1, the adjustable bed 100 includes a mattress support 110 and an outer support perimeter 400.

The mattress support 110 of FIG. 1 includes four distinct segments where each segment is at least coupled to one other segment. For example, as shown in the embodiment depicted in FIG. 1, a head segment 112 is pivotably coupled to a middle segment 114, which is also pivotably coupled to a leg segment 116. The leg segment 116 is also pivotably coupled to the foot segment 118. In embodiments, having the mattress support 110 include multiple segments that are pivotably coupled allows for specific portions of the adjustable bed 100 to be elevated, reclined, and/or otherwise adjusted. In one or more embodiments, the pivotable couplings discussed above for the segments 112, 114, 116, and 118 of the mattress support 110 can be provided by any mechanisms known in the art, such as hinges or hinge-like mechanisms. For example, in the embodiment depicted in FIG. 1, a plurality of hinges 150 couple together the head segment 112 and the middle segment 114, a plurality of hinges 152 couple together the middle segment 114 and the leg segment 116, and a plurality of hinges 154 couple together the leg segment 116 and the foot segment 118. The mattress support 110 can be made from any type of material utilized in the bed or furniture manufacturing industry, and one or more particular materials can be chosen by one skilled in the art for a specific purpose.

As can be seen in FIGS. 2 and 3, the adjustable bed 100 includes a frame assembly 200. The frame assembly 200 can include support rails 210 and 212 that extend along the length of the adjustable bed 100 and can contact and provide support for the mattress support 110. The support rails 210 and 212 depicted in FIGS. 2 and 3 are spaced apart from the side panels 402 and 404 of the outer support perimeter 400. It is appreciated that one skilled in the art would understand what type of materials the frame assembly 200 can be made from and how to make such a frame assembly.

In embodiments, such as that depicted in FIGS. 2 and 3, the support rails 210 and 212 do not extend along the entire length of the mattress support 110. In such embodiments, the support rails 210 and 212 can extend along the length of the mattress support 110 so as to only contact the middle segment 114 and the leg segment 116. Further, in such embodiments, the head segment 112 can be supported by head segment supports 140 and 142, which are coupled to the leg support bracket 120. Also in such embodiments, the foot segment 118 can be supported by at least a portion of the storage compartment 500. In other embodiments, the support rails 210 and 212 can extend along the length of the mattress support 110 to contact any combination of the segments 112, 114, 116, and 118.

The frame assembly 200 is connected to and supported by the outer support perimeter 400 via the frame cross brackets 214 and 216. For example, in the embodiment depicted in FIGS. 2 and 3, the support rails 210 and 212 are coupled to the frame cross brackets 214 and 216, which in turn are fixedly coupled to the side panels 402 and 404 of the perimeter support 400.

The adjustable bed 100 of FIGS. 2 and 3 can include an adjustor assembly 300 for adjusting the position of the mattress support 110 and a mattress. The adjustor assembly 300 can include any commercially available adjustor assembly for use on adjustable beds. The adjustor assembly 300 depicted in FIGS. 2 and 3 includes a head segment lift mechanism 310 and a leg segment lift mechanism 320, both of which are coupled to the frame assembly 200.

Figure 11:
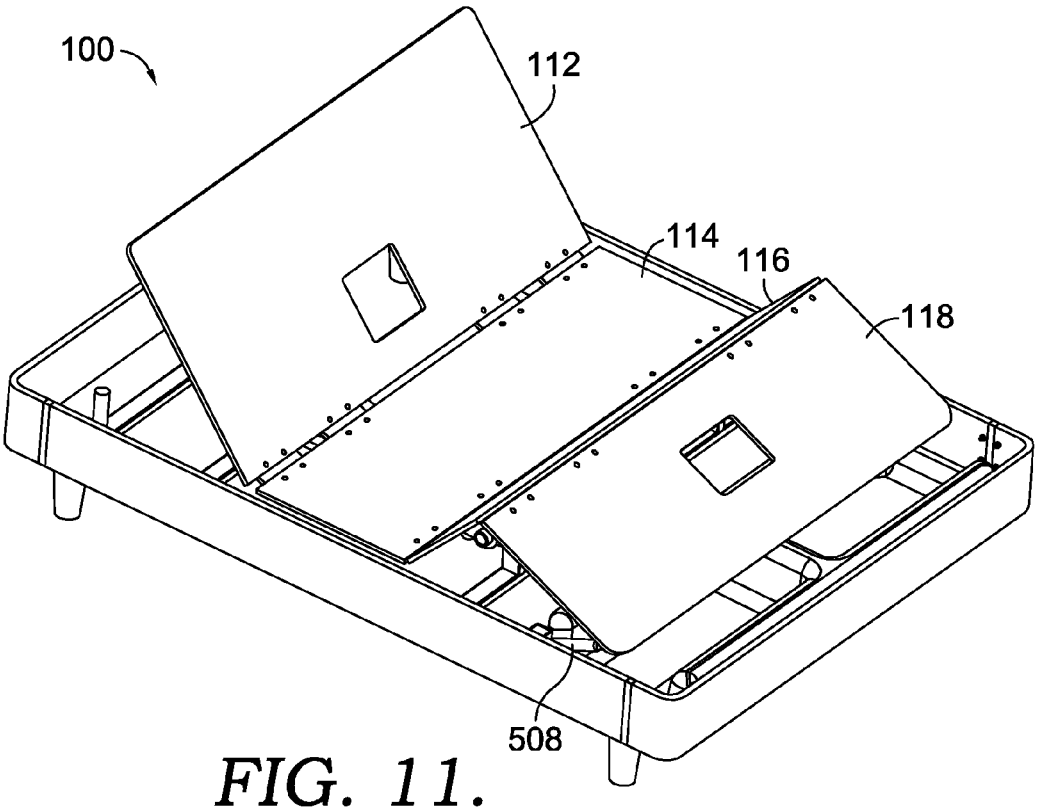
FIG. 11 is a perspective view of yet another configuration of the adjustable bed in FIG. 1, particularly showing the head segment, the leg segment, and the foot segment of the mattress support elevated with respect to the frame assembly to provide an upright seating position for a user, in accordance with an embodiment of the present invention.

The head segment lift mechanism 310 includes lift arms 312 and 314 that are driven by a motor to lift at least a portion of the head segment 112 of the mattress support 110 up and away from the outer support perimeter 400. Similarly, the leg segment lift mechanism 320 includes lift arms 322 and 324 that are driven by a motor to lift at least a portion of the leg segment 116 of the mattress support 110 up and away from the frame assembly 200. One particular configuration of the mattress support 110 having the head segment 112 and the leg segment 116 elevated is depicted in FIG. 11 and is discussed further below.

In embodiments, the adjustable bed 100 includes legs 132, 134, 136, and 138 to support the adjustable bed 100 on a surface. As can be seen in FIGS. 2 and 3, in certain embodiments, the legs 132 and 134 are coupled to a leg support bracket 120, which is coupled to the panels 402 and 404 of the outer support perimeter 400. Similarly, the legs 136 and 138 are coupled to a leg support bracket 130, which is coupled to the panels 402 and 404 of the outer support perimeter 400.

The adjustable bed 100 depicted in FIGS. 2 and 3 can include a storage compartment 500 positioned near the foot end of the adjustable bed 100. In such embodiments, a portion, e.g., an exterior bottom portion, of the storage compartment 500 can rest up against the leg support bracket 130 to provide support for the storage compartment 500. The storage compartment 500 is discussed in detail below.

As discussed above, the outer support perimeter 400 of the adjustable bed 100 can provide support to a number of components of the adjustable bed 100. For example, the outer support perimeter 400 is coupled to the leg support brackets 120 and 130, and the frame cross brackets 214 and 216. These brackets 120, 130, 214, and 216, in turn, support a number of components of the adjustable bed 100, e.g. the frame assembly 200, the adjustor assembly 300, and the storage compartment 500, and thus, the outer support perimeter 400 not only defines the outer perimeter of the adjustable bed 100, but also provides structural support for various components of the adjustable bed 100. The manner in which these components are coupled to the outer perimeter support 400 is discussed further below.

The outer support perimeter 400 can be made of any type of commercially available material as long as such material can provide the structural support necessary to support the various adjustable bed components discussed above. In certain embodiments, the outer support perimeter 400 can be made of a composite material, such as a material having a thermoplastic core and a metal coating or metal outer surface.

As discussed above, the outer support perimeter 400 can include a number of panels connected end to end. For example, as can be seen in FIGS. 2 and 3, the outer support perimeter 400 can include a head panel 406 connected to the side panels 402 and 404 on opposite ends of the head panel 406, and a foot panel 408 connected to the side panels 402 and 404 on opposite ends of the foot panel 408. It is appreciated that any number of panels can be utilized to form the outer support perimeter discussed herein.

Figure 4:
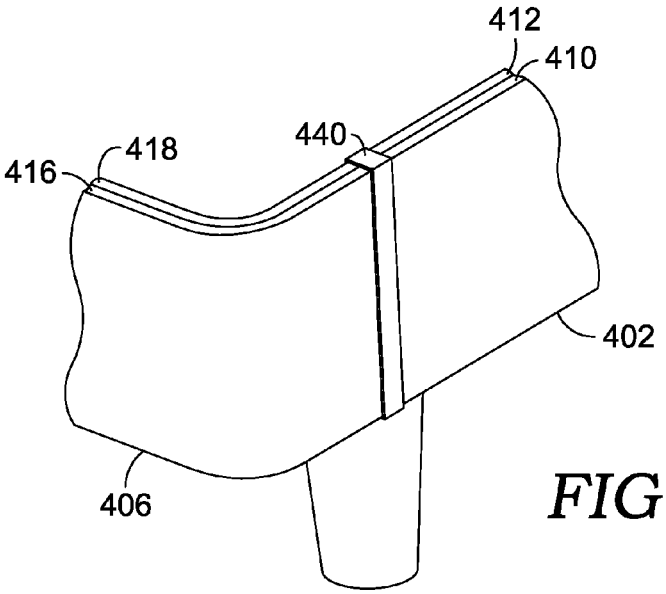
FIG. 4 is a perspective view of a close up area designated in FIG. 3, particularly showing a side panel and head panel of the outer support perimeter connected together, and a sleeve positioned between the side and head panels, in accordance with an embodiment of the present invention.
Figure 5:
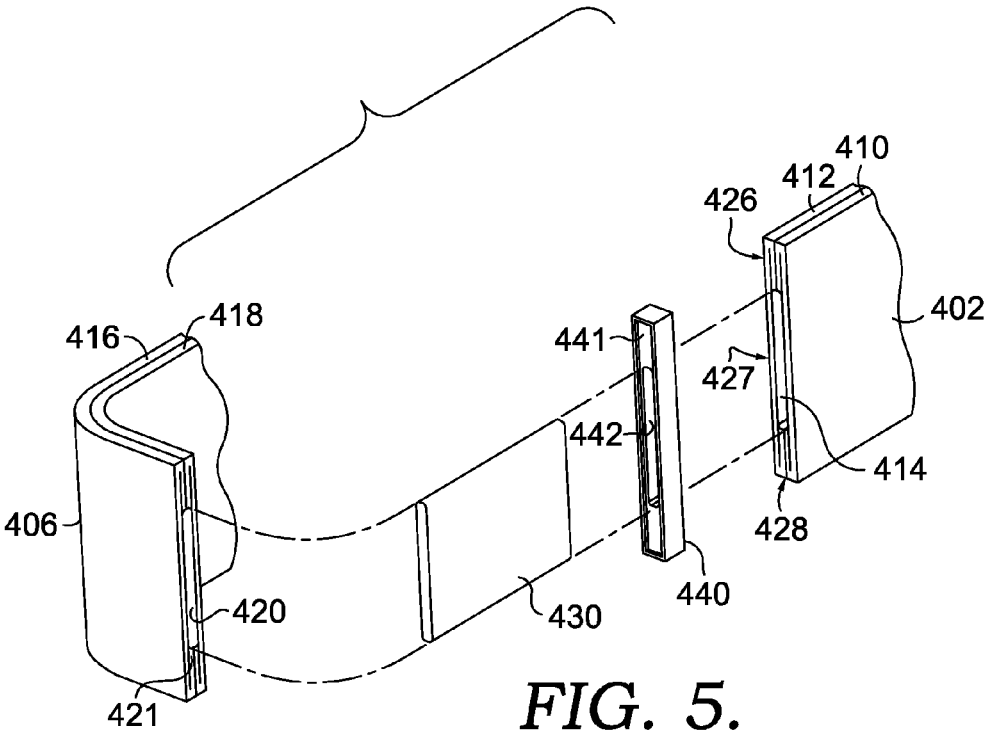
FIG. 5 is an exploded view of the close up area illustrated in FIG. 4, particularly showing a connecting member positioned inside a void of both the head and side panels, in accordance with an embodiment of the present invention.

In the embodiment depicted in FIGS. 4 and 5, each panel of the outer support perimeter 400, e.g., panels 402 and 406 are comprised of two separate layers bonded together. For example, the side panel 402 includes the separate layers 410 and 412, while the head panel 406 includes the separate layers 416 and 418. As best seen in FIG. 5, each of these layers can be folded over itself at a top and bottom region to provide a double layer portion. In such embodiments, once the panels are assembled in this fashion, they can include a top portion, e.g., the top portion 426 of the side panel 402, having four layers of material, a middle portion, e.g., the middle portion 427 of the side panel 402, having two layers of material, and a bottom portion, e.g., the bottom portion 428 of the side panel 402, having four layers of material. In such embodiments, this configuration of the layers of the panels 402 and 406 of the outer support perimeter 400 can provide increased strength so that the outer support perimeter 400 can support the various components of the adjustable bed 100. It is appreciated that one skilled in the art would understand how to fold over a portion of a panel layer and bond together various panel layers in order to form the panels 402 and 406 depicted in FIGS. 4 and 5.

As best seen in FIG. 5, the side panel 402 and the head panel 406 are connected together using a panel connection member 430. The panel connection member 430 can be made of the same material as the panels 402 and 406, or of a different material. In one embodiment, the panel connection member 430 can be made from a thermoplastic material and/or a metal material, e.g., aluminum. The panel connection member 430 can be received in a void 414 of the side panel member 402 and/or in a void 420 of the head panel member 406. In certain embodiments, one or more of the voids 414 and 420 can be defined by a middle portion of a panel, e.g., the middle portion 427 of the side panel 402, that has only two outer layers of material (as opposed to four layers of material).

While not shown in the figures, when the ends of the side panel 402 and the head panel 406 are connected via the connecting member 430, a connection seam exists. In one or more embodiments, a sleeve member 440 can be utilized to cover such a connection seam and to provide added stability and strength to the outer support perimeter 400. For example, as shown in the embodiments depicted in FIGS. 4 and 5, the sleeve member 440 includes a void 442, through which the panel connection member 430 can extend, allowing the panel connection member 430 to be covered by a portion of the sleeve member 440 and still be received inside the voids 414 and 420. In such embodiments, the sleeve member 440 can provide added stability to the connection seam as discussed further below, in addition to providing an aesthetically pleasing cover for the connection seam. In embodiments, the sleeve member 440 can be made of any material, such as a plastic and/or metal material, and a particular material can be chosen by one skilled in the art for a specific purpose.

In certain embodiments, the sleeve member 440 can include a recessed portion, e.g., recessed portion 441, for receiving a portion of the end of a panel, e.g., the end 421 of the head panel 406. While not shown in the figures, a similar recessed portion can be provided on the opposite side of the sleeve member 440 for the side panel 402. In such embodiments, further stability can be obtained for the outer support perimeter 400 by having the ends of the panels received in recessed portions, e.g., recessed portion 441 of the sleeve member 440. In such embodiments, the ends of the panels will be nested in a portion of the sleeve member 440 thereby reducing any sliding movement between the panels 402 and 406 and the sleeve member 440. In an embodiment not depicted in the figures, the sleeve member, e.g. the sleeve member 440, does not include a recessed portion and can be flush with the panels, e.g., flush with the side panel 402 and the head panel 406.

Figure 6:
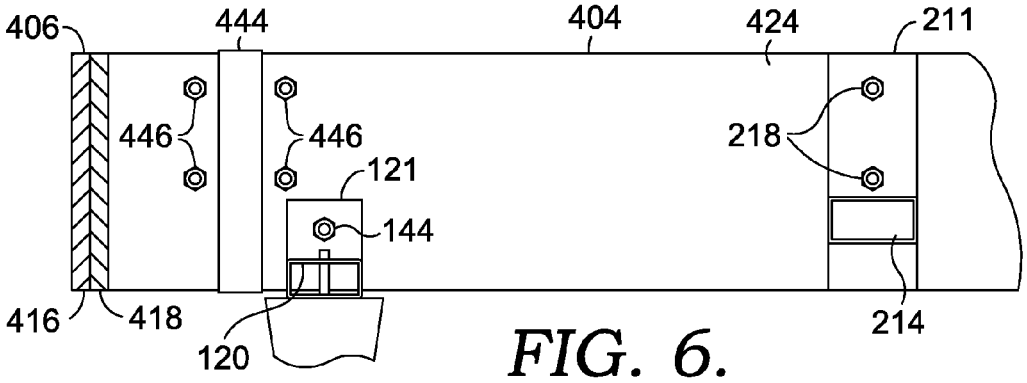
FIG. 6 is a cross-sectional view of the region designated in FIG. 3, particularly showing the position of fasteners that secure a connecting member in place relative to the position of a head panel and a side panel of the outer support perimeter, in accordance with an embodiment of the present invention.
Figure 7:
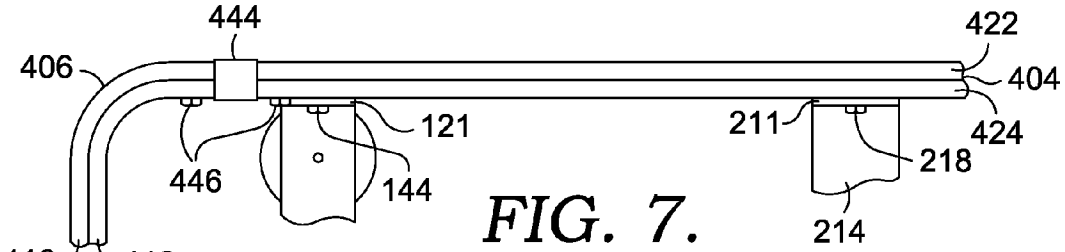
FIG. 7 is a top view of the region of the adjustable bed illustrated in FIG. 6, particularly showing the position of the fasteners with respect to the two layers of each of the head and side panels, in accordance with an embodiment of the present invention.

As discussed above, in embodiments, one or more panels of the outer support perimeter 400 can be comprised of at least two layers of material bonded together. In such embodiments, the inner layer of material, e.g., the inner layer 424 of the side panel 404 that faces the interior of the adjustable bed 100, can be utilized to secure one or more components of the adjustable bed 100 to the outer support perimeter 400, in such a manner that no fasteners or fastening mechanisms are visible on the exterior layer 422 of the side panel 404. FIGS. 6 and 7 illustrate this embodiment. FIG. 6 depicts a cross section of the side panel 404 and head panel 406 along the line 6 in FIG. 3, and FIG. 7 depicts a top view of the region depicted in FIG. 6. In such embodiments, the leg support bracket 120 can be secured to the inner layer 424 of the side panel 404 via a bracket 121 and a fastener 144, such as a bolt. Yet, in such embodiments, the fastener 144 does not penetrate through the exterior layer 422 of the side panel 404, nor is the fastener 144 visible when viewing the exterior layer 422. Similarly, the fasteners 446 adjacent to the sleeve member 444 that are used to secure a panel connection member inside a void of the side panel 404 and the head panel 406 are not visible on the exterior layer 422 of the side panel 404. Further, in such embodiments, the fasteners 218, which secure the frame support rail 214 to the side panel 404 (via a bracket 211), are also not visible on the exterior layer 422 of the side panel 404. Such a configuration of multiple layers of the outer support perimeter 400 can provide the strength and stability to secure various components of the adjustable bed 100 while providing an aesthetic outer surface that shields these various components, and the fasteners utilized to provide their support.

Figure 8:
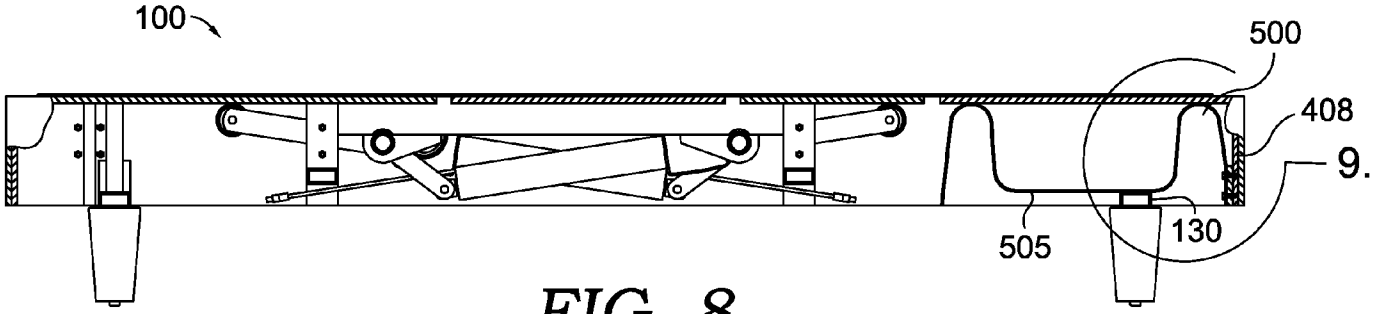
FIG. 8 is a side view of the adjustable bed of FIG. 1, having portions of a side panel removed to illustrate the position of the storage compartment within the adjustable bed, in accordance with an embodiment of the present invention.
Figure 9:
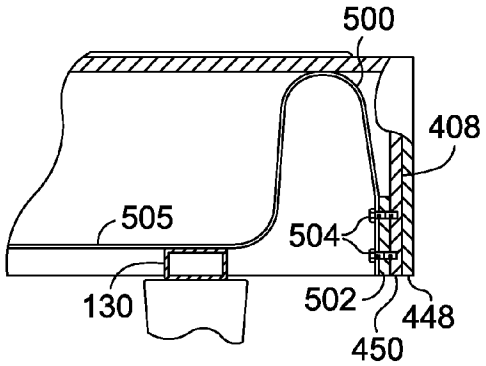
FIG. 9 is a close up view of the area designated in FIG. 8, particularly showing a mounting bracket for securing the storage compartment to the foot panel of the outer support perimeter, in accordance with an embodiment of the present invention.

As discussed above, in certain embodiments, the adjustable bed 100 can include a storage container 500. FIGS. 8 and 9 depict a side view of the adjustable bed 100 with the side panel 402 removed to reveal the position of the storage container 500 and to illustrate one embodiment for how the storage compartment 500 can be secured to the adjustable bed 100.

As can be seen in FIGS. 8 and 9, the storage compartment 500 can be secured to the outer support perimeter 400 such that no fasteners or fastening mechanisms are visible on the exterior surface of the outer support perimeter 400. For example, as depicted in FIGS. 8 and 9, fasteners 504 can secure the storage compartment 500 to the foot panel 408 of the outer support perimeter 400. In such embodiments, the fasteners 504 can extend through a portion of the storage compartment 500, through a foot panel mounting bracket 502, and into the interior layer 450 of the foot panel 408. Further, in such embodiments, the fasteners 504 are not visible when viewing the exterior layer 448 of the foot panel 408 from a position away from the adjustable bed 100. It should be appreciated that, although only one foot panel mounting bracket 502 is depicted, any number of foot panel mounting brackets can be utilized to secure the storage container 500 to the outer support perimeter 400. It should also be appreciated that the storage compartment 500 can be secured to the outer support perimeter 400 with additional brackets and fasteners, or with brackets at different positions than that depicted in FIGS. 8 and 9.

In embodiments, as discussed above, the storage compartment 500 can also be supported by contacting the leg support bracket 130. For example, as can be seen in FIGS. 8 and 9, the bottom exterior portion 505 of the storage container 500 can rest on top of the leg support bracket 130 to provide additional support for the storage container 500.

In one or more embodiments, the storage compartment 500 can be accessed by a user lifting the foot segment 118 of the mattress support 110 up and away from the storage compartment 500. In such embodiments, the foot segment 118 will pivot up relative to the leg segment 116 of the mattress support 110, such as that depicted in FIG. 10.

Figure 10:
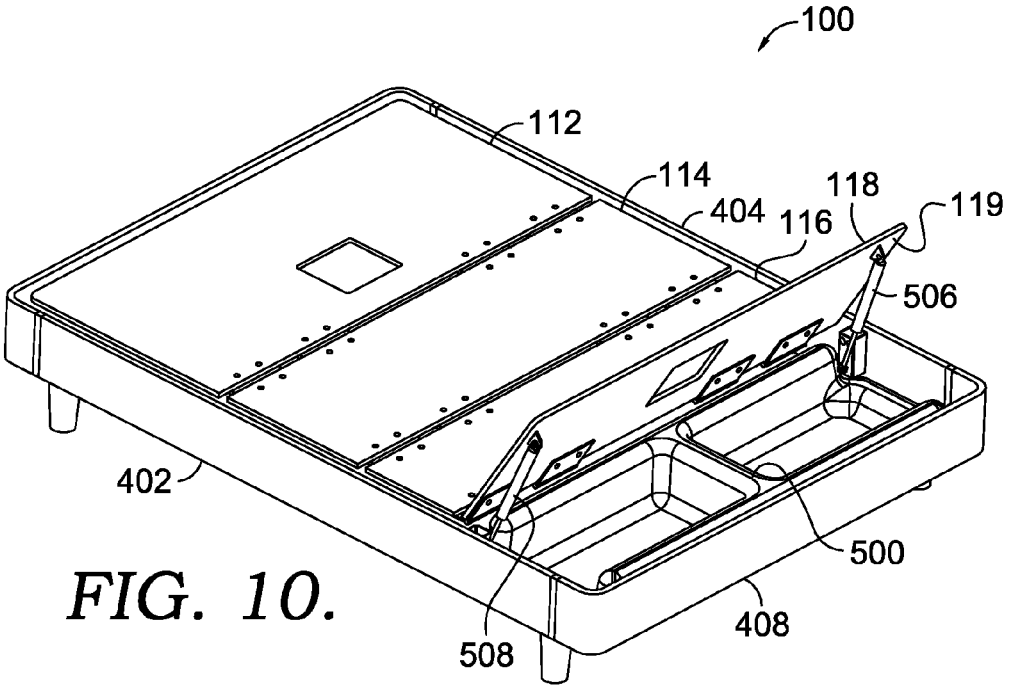
FIG. 10 is a perspective view of another configuration of the adjustable bed of FIG. 1, particularly showing the foot segment of the mattress support elevated with respect to the frame assembly to provide access to the storage compartment, and the position of the foot segment extension members with respect to the outer support perimeter and the foot segment, in accordance with an embodiment of the present invention.

In embodiments, the adjustable bed 100 can include one or more extension members to facilitate the raising of the foot segment 118 to allow access to the storage compartment 500. In the embodiment depicted in FIG. 10, gas springs 506 and 508 can be used to facilitate the raising and lowering of the foot segment 118. The gas springs 506 and 508 can be coupled to the side panels 402 and 404, respectively, and also connected to a portion of the interior surface 119 of the foot segment 118, as depicted in FIG. 10. In such embodiments, the gas springs 506 and 508 can facilitate the raising of the foot segment 118 by extending upward to allow for at least a portion of the foot segment 118 to lift upward. Additionally, in such embodiments, the gas springs 506 and 508 can act as turnbuckles so that as the adjustor assembly 300 lifts up the leg segment 116, the gas springs 506 and 508 hold the end of the foot segment 118 that is coupled to the gas springs 506 and 508 down, thereby creating an upside down "V" shape with the leg segment 116 and the foot segment 118, such as that depicted in FIG. 11.

As discussed previously, the foot segment 118 and the leg segment 116 can be pivotably coupled to one another via one or more hinges. In certain embodiments, one or more double acting hinges can be utilized to pivotably couple the leg segment 116 and the foot segment 118. In such embodiments, the double acting hinges can allow for the foot segment 118 to pivot up so that at least a portion of the foot segment 118 is above the leg segment 116 (e.g., as depicted in FIG. 10), and to pivot down so that at least a portion of the foot segment 118 is below a portion of the leg segment 116 (e.g., as depicted in FIG. 11). Further, in such embodiments, the double acting hinges 506 and 508 can allow for the adjustable bed 100 to shift between the configuration shown in FIG. 10 to the configuration shown in FIG. 11. It should be appreciated that any other mechanism known by one skilled in the art, besides double acting hinges or other types of hinges, can be utilized to provide these movements of the foot segment 118 and the leg segment 116.

Figure 12:
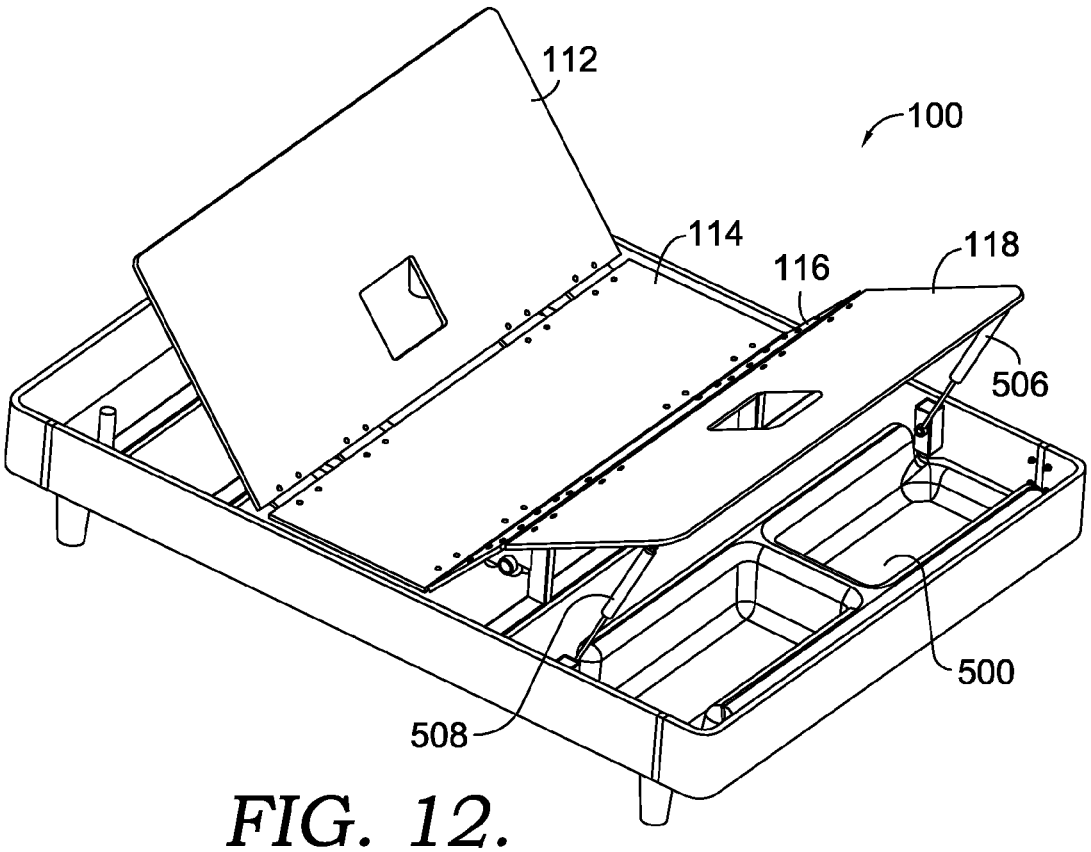
FIG. 12 is a perspective view of another configuration of the adjustable bed in FIG. 1, particularly showing the head segment and the leg segment elevated with respect to the frame assembly, and showing the foot segment lifted up to provide access to the storage compartment, in accordance with an embodiment of the present invention.

In embodiments, the foot segment 118 can be lifted, e.g., by a user, when the bed 100 is in any position to allow access to the storage compartment 500. For example, as depicted in FIG. 12, the foot segment 118 is raised up and away from the storage compartment 500 while the head segment 112, the middle segment 114, and the leg segment 116 are in the same position as that depicted in FIG. 11. In embodiments, the lifting of the foot segment 118 no matter what position the segments 112, 114, 116, and/or 118 of the bed 100 are in, can be at least partly facilitated by the use of one or more double acting hinges (or equivalent mechanism), and/or one or more gas springs 506 and 508, as discussed above. It is appreciated that the foot segment 118 can be lifted up when the segments 112, 114, 116, and/or 118 of the bed 100 are in other positions than those depicted in the figures.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An adjustable bed comprising:

a frame assembly, wherein the frame assembly comprises at least two support rails that are spaced apart from one another;

a mattress support having opposing interior and exterior surfaces, wherein the frame assembly is coupled to at least a first portion of the interior surface of the mattress support, wherein the exterior surface of the mattress support is configured to contact and support a mattress, wherein the mattress support comprises a foot segment and a leg segment pivotably coupled to one another;

an adjustor assembly coupled to the frame assembly and in contact with a second portion of the interior surface of the mattress support, wherein the adjustor assembly is configured to shift the mattress support into a plurality of configurations;

a storage compartment defined by a bottom surface, at least one sidewall, and at least a portion of the interior surface of the mattress support that opposes at least a third portion of the bottom surface, wherein the storage compartment is configured to be accessible by shifting the foot segment of the mattress support away from the bottom surface of the storage compartment; and an outer support perimeter comprising opposing head and foot panels, and opposing first and second side panels, wherein the mattress support is positioned within the outer support perimeter, wherein the mattress support is spaced apart from at least the opposing head and foot panels of the outer support perimeter when the mattress support is in a substantially flat configuration of the plurality of configurations, and wherein the at least two support rails of the frame assembly extend in a direction that is substantially parallel to the direction of extension of the first and second side panels of the outer support perimeter, and wherein the at least two support rails are spaced apart from the first and second side panels.

2. The adjustable bed according to claim 1, further comprising at least one extension member configured to facilitate the shifting of the foot segment up and away from the storage compartment.

3. The adjustable bed according to claim 2, wherein the at least one extension member comprises a gas spring.

4. The adjustable bed according to claim 3, wherein the gas spring is coupled to the outer support perimeter and to at least a portion of the foot segment.

5. The adjustable bed according to claim 1, wherein the outer support perimeter further comprises a plurality of panel connecting members, wherein a first panel connecting member of the plurality of panel connecting members at least partly couples together the foot panel and the first side panel, thereby creating a connection seam, wherein the first panel connecting member is at least partly received inside an interior void of each of the foot panel and the first side panel.

6. The adjustable bed according to claim 5, further comprising a sleeve member that covers the connection seam.

7. The adjustable bed according to claim 1, further comprising at least one leg support bracket that is coupled to the first and second side panels of the outer support perimeter, wherein the leg support bracket is configured to support at least a portion of the storage compartment.

8. The adjustable bed according to claim 1, wherein the storage compartment is accessible when the mattress support is in at least one of the plurality of configurations.

9. The adjustable bed according to claim 1, wherein the storage compartment comprises a plastic molded shelf.

10. An adjustable bed comprising:

a frame assembly, wherein the frame assembly comprises at least two support rails that are spaced apart from one another;

a mattress support comprising a foot segment and a leg segment pivotably coupled to one another;

an adjustor assembly coupled to the frame assembly and contacting a portion of the mattress support, wherein the adjustor assembly is configured to shift the mattress support into a plurality of configurations;

a storage compartment defined by a bottom surface, at least one sidewall, and at least a portion of the foot segment of the mattress support, wherein the storage compartment is configured to be accessible by shifting the foot segment of the mattress support away from the bottom surface of the storage compartment;

at least one extension member configured to facilitate the shifting of the foot segment up and away from the storage compartment; and an outer support perimeter comprising opposing head and foot panels, and opposing first and second side panels, wherein the mattress support is positioned within the outer support perimeter, wherein the mattress support is spaced apart from at least the opposing head and foot panels when the mattress support is in a substantially flat configuration of the plurality of configurations, and wherein the at least two support rails of the frame assembly extend in a direction that is substantially parallel to the direction of extension of the first and second side panels of the outer support perimeter, and wherein the at least two support rails are spaced apart from the first and second side panels.

11. The adjustable bed according to claim 10, wherein the outer support perimeter further comprises a plurality of panel connecting members, wherein a first panel connecting member of the plurality of panel connecting members at least partly couples together the foot panel and the first side panel, thereby creating a connection seam, wherein the first panel connecting member is at least partly received inside an interior void of each of the foot panel and the first side panel.

12. The adjustable bed according to claim 11, further comprising a sleeve member that covers the connection seam.

13. The adjustable bed according to claim 10, wherein the at least one extension member comprises a gas spring, wherein the gas spring is coupled to the outer support perimeter and to the foot segment.

14. The adjustable bed according to claim 10, wherein the storage compartment is accessible when the mattress support is in at least one of the plurality of configurations.

15. The adjustable bed according to claim 10, wherein the storage compartment comprises a plastic material.

16. The adjustable bed according to claim 10, wherein the storage compartment is coupled to at least a portion of the outer support perimeter.

17. The adjustable bed according to claim 10, wherein at least a portion of the frame assembly is coupled to at least a portion of the outer support perimeter.

* * * * *